US009299276B1

(12) United States Patent
Enrico

(10) Patent No.: US 9,299,276 B1
(45) Date of Patent: Mar. 29, 2016

(54) MOBILE MOTIONABLE SIGN APPARATUS

(71) Applicant: Richard H. Enrico, Eden Prairie, MN (US)

(72) Inventor: Richard H. Enrico, Eden Prairie, MN (US)

( * ) Notice: Subject to any disclaimer, the term of this patent is extended or adjusted under 35 U.S.C. 154(b) by 0 days.

(21) Appl. No.: 14/736,332

(22) Filed: Jun. 11, 2015

(51) Int. Cl.

| | |
|---|---|
| ***G09F 7/00*** | (2006.01) |
| ***G09F 11/23*** | (2006.01) |
| ***G09F 21/00*** | (2006.01) |
| ***G09F 15/00*** | (2006.01) |

(52) U.S. Cl.
CPC ..... *G09F 11/23* (2013.01); *G09F 15/0087* (2013.01); *G09F 21/00* (2013.01)

(58) Field of Classification Search
CPC ..... G09F 11/23; G09F 15/0087; G09F 19/00; G09F 21/00; G09F 7/22
USPC ..... 40/473, 612
See application file for complete search history.

(56) References Cited

U.S. PATENT DOCUMENTS

| | | | | | |
|---|---|---|---|---|---|
| 2,245,940 | A * | 6/1941 | Seares | G09F 11/23 | 40/614 |
| 2,528,962 | A * | 11/1950 | Lieutard | G08G 1/096716 | 116/63 P |
| 4,077,144 | A * | 3/1978 | Smits | G09F 21/04 | 340/980 |
| 4,777,751 | A * | 10/1988 | Pasquale | E01F 1/005 | 182/17 |
| 6,101,750 | A * | 8/2000 | Blesener | G09F 13/04 | 340/815.53 |
| 6,571,495 | B1 * | 6/2003 | Margaronis | G09F 15/00 | 40/473 |
| 6,808,081 | B1 * | 10/2004 | Citro | B65D 25/2805 | 116/63 P |
| 7,069,681 | B2 * | 7/2006 | Noble | G09F 7/18 | 40/490 |
| 7,268,701 | B2 * | 9/2007 | Rohl | G08G 1/0955 | 116/63 P |
| 8,164,483 | B1 * | 4/2012 | Phillips | E01F 9/0116 | 116/63 P |
| 8,246,068 | B2 * | 8/2012 | MacDougall | G09F 7/20 | 280/491.1 |
| 8,887,424 | B2 * | 11/2014 | Adams | G09F 7/22 | 116/63 P |
| 2003/0115783 | A1 * | 6/2003 | Woosley | G09F 7/00 | 40/584 |
| 2007/0210236 | A1 * | 9/2007 | Yungner | B60P 3/14 | 248/678 |
| 2008/0209783 | A1 * | 9/2008 | Trainer | B62K 3/007 | 40/606.02 |
| 2013/0111791 | A1 * | 5/2013 | Bazos | G09F 13/18 | 40/544 |
| 2013/0185967 | A1 * | 7/2013 | Adams | G09F 7/22 | 40/218 |
| 2013/0194162 | A1 * | 8/2013 | Autenzeller | G09F 11/025 | 345/1.3 |
| 2015/0027011 | A1 * | 1/2015 | Adams | G09F 7/22 | 40/218 |

* cited by examiner

*Primary Examiner* — Shin Kim
(74) *Attorney, Agent, or Firm* — Dave Alan Lingbeck

(57) ABSTRACT

A mobile motionable sign apparatus for supporting and moving a sign relative to the base apparatus. The mobile motionable sign apparatus includes a base assembly including a base member with wheels mounted thereto; a motive support assembly removably coupled to the base member and including a pivot member; and a sign support assembly movably coupled to the pivot member and including a motor support member coupled and movable relative to the pivot member and further including a motor mounted to the motor support member and also including sign support members connectable to the motor support member.

16 Claims, 6 Drawing Sheets

MOBILE MOTIONABLE SIGN APPARATUS

BACKGROUND OF THE INVENTION

1. Field of the Invention

The present invention relates to sign support devices and more particularly pertains to a new mobile motionable sign apparatus for supporting and moving a sign relative to the base apparatus.

2. Description of the Prior Art

The use of sign support devices is known in the prior art. More specifically, sign support devices heretofore devised and utilized are known to consist basically of familiar, expected and obvious structural configurations, notwithstanding the myriad of designs encompassed by the crowded prior art which have been developed for the fulfillment of countless objectives and requirements.

While these devices fulfill their respective, particular objectives and requirements, the aforementioned patents do not disclose a new mobile motionable sign apparatus.

SUMMARY OF THE INVENTION

The general purpose of the present invention, which will be described subsequently in greater detail, is to provide a new mobile motionable sign apparatus which has many of the advantages of the sign support devices mentioned heretofore and many novel features that result in a new mobile motionable sign apparatus which is not anticipated, rendered obvious, suggested, or even implied by any of the prior art sign support devices, either alone or in any combination thereof. The present invention includes a base assembly including a base member with wheels mounted thereto; a motive support assembly removably coupled to the base member and including a pivot member; and a sign support assembly movably coupled to the pivot member and including a motor support member coupled and movable relative to the pivot member and further including a motor mounted to the motor support member and also including sign support members connectable to the motor support member. None of the prior art includes the combination of the elements of the present invention.

There has thus been outlined, rather broadly, the more important features of the mobile motionable sign apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new mobile motionable sign apparatus which has many of the advantages of the sign support devices mentioned heretofore and many novel features that result in a new mobile motionable sign apparatus which is not anticipated, rendered obvious, suggested, or even implied by any of the prior art sign support devices, either alone or in any combination thereof.

Still another object of the present invention is to provide a new mobile motionable sign apparatus for supporting and moving a sign relative to the base apparatus.

Still yet another object of the present invention is to provide a new mobile motionable sign apparatus that intends to draw attention to the sign by moving the sign in figure eight path.

Even still another object of the present invention is to provide a new mobile motionable sign apparatus that is protected from theft with motion sensors should someone attempt to lift the apparatus a particular distance off the ground.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
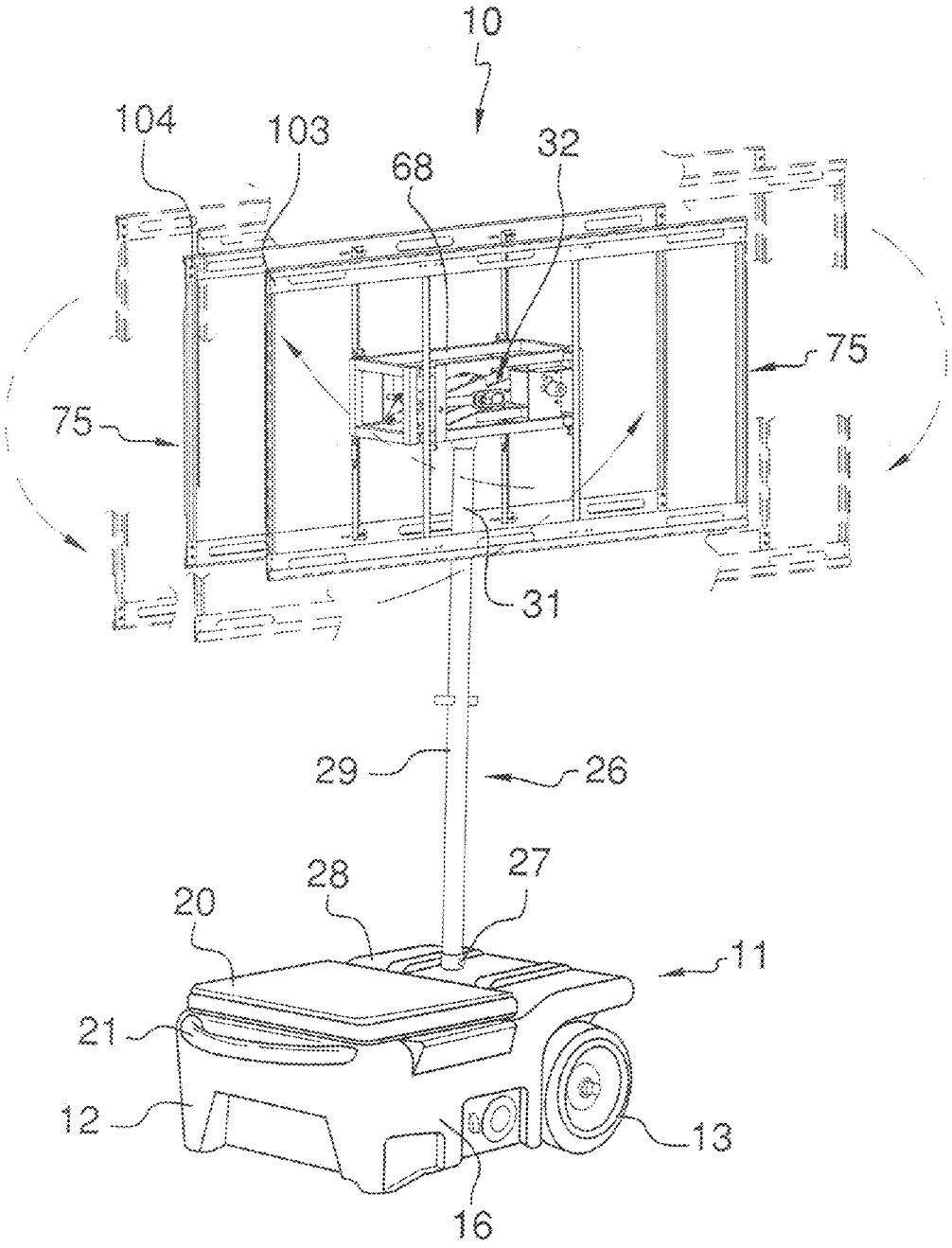
FIG. 1 is a perspective view of the mobile motionable sign apparatus.

With reference now to the drawings, and in particular to FIGS. 1 through 6 thereof, a new mobile motionable sign apparatus embodying the principles and concepts of the present invention and generally designated by the reference numeral 10 will be described.

As best illustrated in FIGS. 1 through 6, the mobile motionable sign apparatus 10 may generally comprise a base assembly 11 including a base member 12 with wheels 13, 14 conventionally mounted thereto, and may also comprise a motive support assembly 26 removably coupled to the base member 11 and including a pivot member 32, and may further comprise a sign support assembly 75 movably coupled to the pivot member 32 and including a motor support member 68 coupled and movable relative to the pivot member 32 and further including a motor 102 conventionally mounted to the motor support member 68 and also including sign support members 103, 104 conventionally mountable to the motor support member 68.

Figure 2:
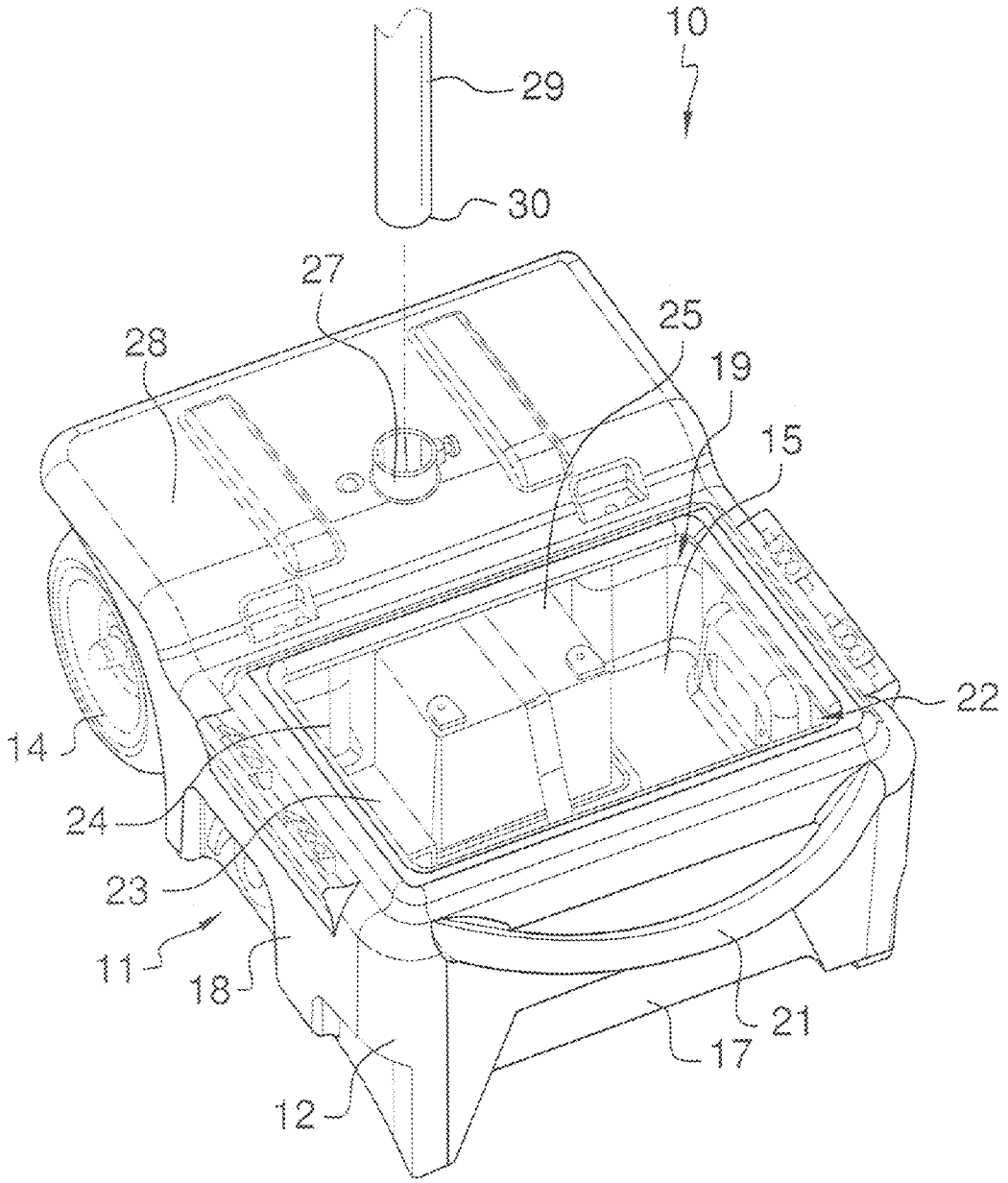
FIG. 2 is a top perspective view of the base member of the present invention.
Figure 3:
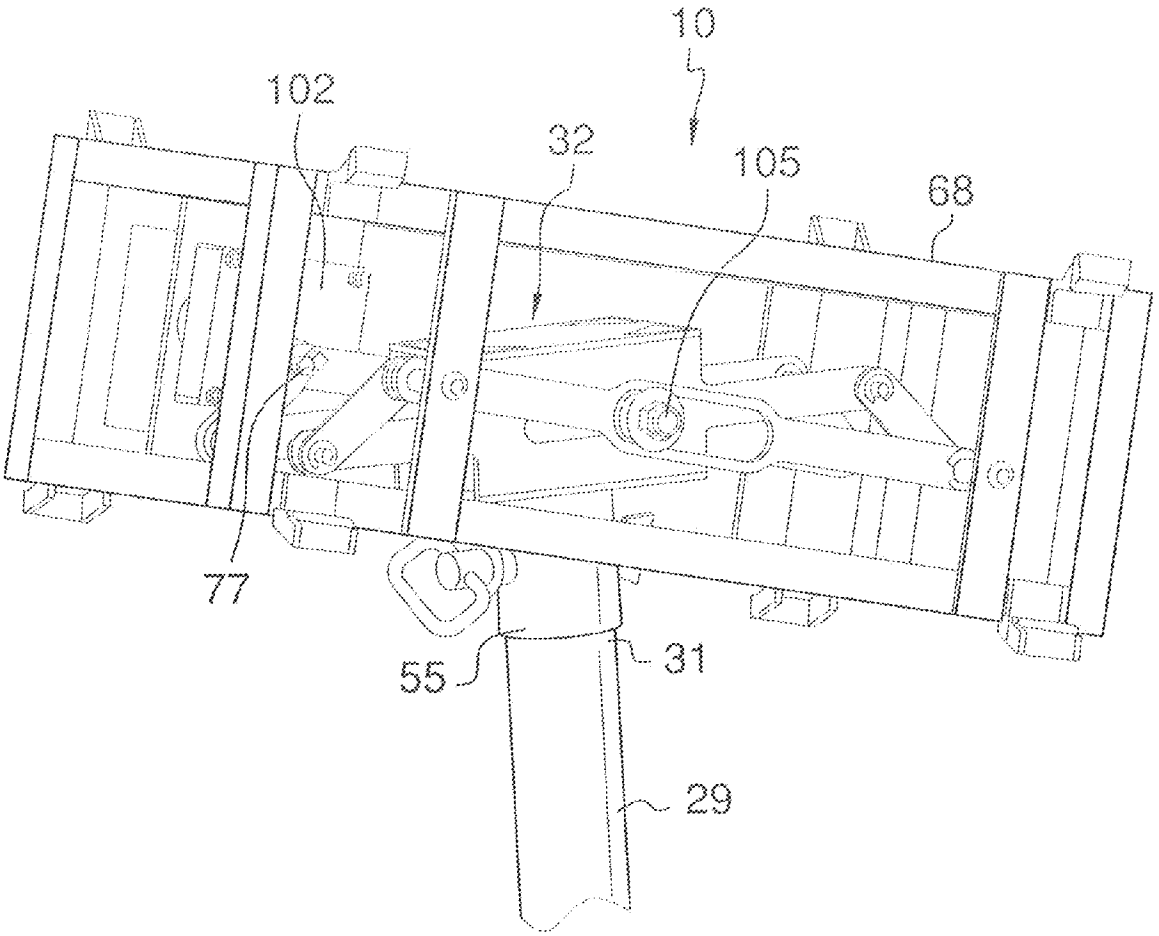
FIG. 3 is a side elevation view of the sign support assembly of the present invention with a partial view of the expandable pole.

As illustrated in FIGS. 1-3, the base member 12 has a bottom wall 15, side walls 16-18, a compartment 19 disposed therein, an opening 22 into the compartment 19, a cover 20 removably and conventionally disposed over the opening 22, and a handle 21 conventionally attached to one of the side walls 16, 17 for moving the base member 12. The mobile motionable sign apparatus 10 may further include a battery 25 conventionally carried in the compartment 19 and upon the bottom wall 15 and in conventional communication with the motor 102 in FIG. 3 for the energizing thereof and may also include a gravity sensor 23 conventionally disposed in the compartment 19 and in conventional communication with the battery 25 using wires (not shown) and may further include a sound-producing mechanism 24 in conventional communication with the gravity sensor 23 and the battery 25 also using wires (not shown) to emit an alarm upon the lifting of the base member 12 a selected distance off the ground.

As shown in FIGS. 1 through 6, the motive support assembly 26 may also include a first coupler 27 conventionally attached and welded to a top 28 of the base member 12 adjacent to the opening 22, and may further include an extendable pole 29 having interconnecting tubular sections and removably extending upwardly from the base member 12 and having a top end portion 31 and a bottom end portion 30 conventionally retainable in the first coupler 27 with a pin member. The pivot member 32 may be removably retained about the top end portion 31 of the extendable pole 29, and includes a top plate 33, a bottom plate 36, opposed side plates 39, 47 spaced apart from one another and conventionally interconnecting and welded to the top and bottom plates 33, 36 and a second coupler 55 conventionally depending from and welded to the bottom plate 36 and removably retained about the top end portion 31 of the extendable pole 29. Each of the side plates 39, 47 may have a longitudinal slot 46, 54 disposed therethrough. The pivot member 32 may further include a connector member 105 such as a bolt with a threaded nut extending through and movable within the longitudinal slots 46, 54 of the side plates 39, 47. The side plates 39, 47 may have opposed ends 40, 41, 48, 49. The pivot member 32 may further include elongate extension members 42, 44, 50, 52 integrally attached to the opposed ends 40, 41, 48, 49 of the side plates 39, 47 and longitudinally aligned and extending outwardly from the opposed ends 40, 41, 48, 49 of the side plates 39, 47 with each of the elongate extension members 42, 44, 50, 52 having a distal end 43, 45, 51, 53. Each elongate extension member 42, 44, 50, 52 is integrally attached to a respective opposed end 40, 41, 48, 49 of a respective side plate 39, 47. The top and bottom plates 33, 36 may have opposed ends 34, 35, 37, 38 with the elongate extension members 42, 44, 50, 52 extending outwardly beyond the ends 34, 35, 37, 38 of the top and bottom plates 33, 36. The second coupler 55 is a tube conventionally attached and welded to the bottom plate 36 and having a longitudinal axis disposed perpendicular to the bottom plate 36 and having an open distal end 56 and a bore 58 disposed therein and having a side wall 57 with diametrically opposed holes disposed therethrough. The top end portion 31 of the extendable pole 29 may be removably received in the bore 58 of the tube with the pivot member 32 fastenable to the extendable pole 29 with a pin removably extended through the diametrically opposed holes. The motive support assembly 26 may also include linkage members 59, 62, 65*a-b* each having first and second ends 60, 61, 63, 64, 66*a-b*, 67*a-b* and may further include bearing members each conventionally interconnecting and respectfully coupling a respective first end 60, 63, 66*a-b* of a respective linkage member 59, 62, 65*a-b* to a respective distal end 43, 45, 51, 53 of a respective elongate extension member 42, 44, 50, 52 with the linkage members 59, 62, 65*a-b* being rotatable relative to the elongate extension members 42, 44, 50, 52.

As illustrated in FIGS. 3 through 6, the motor support member 68 may include elongate support members 69*a-b*, 70*a-b* spaced apart and each having ends and may also include lateral support members 71*a-b*, 72*a-b* each conventionally and respectfully interconnecting and welded to a pair of the elongate support members 69*a-b*, 70*a-b* at the ends thereof. The motor support member 68 may further include cross support members 73*a-b*, 74*a-b* each conventionally attached and welded to and interconnecting a respective pair of the elongate support members 69*a-b*, 70*a-b* and a respective pair of the lateral support members 71*a-b*, 72*a-b* to form a rectangular frame. The sign support assembly 75 in FIG. 1 may also include a motor bracket 76 conventionally attached and welded to at least one of the elongate support members 69*a-b*, 70*a-b* with the motor 102 conventionally attached to the motor bracket 76 and having a rotatable shaft 77, and may further include post support members 78-80 each conventionally interconnecting and welded to a respective pair of the elongate support members 69*a-b*, 70*a-b*. The sign support assembly 75 may also include posts 82-84 each conventionally fastened to a respective post support member 78-80 and extending inwardly of the motor support member 68 and perpendicular to the elongate support members 69*a-b*, 70*a-b*, and may further include bearings each conventionally interconnecting and coupling a respective second end 61, 64, 67*a-b* of respective linkage member 59, 62, 65*a-b* to a respective post 82-84. The rotatable shaft 77 may be conventionally connected to the second end 61 of one of the linkage members 59 for rotation therewith. The motor 102 moves in a figure eight path relative to the pivot member 32 when energized. The sign support assembly 75 may further include elongate guide members 86, 89 one of which conventionally interconnects the rotatable shaft 77 to one of the posts 82 and another of which conventionally interconnects other posts 83-84. Each of the elongate guide members 86, 89 may have an intermediate portion 87, 90 with a longitudinal slot 88, 91 disposed therethrough. The connector member 105 may be a bolt with a nut threaded to the bolt and may extend through the longitudinal slots 88, 91 of the elongate guide members 86, 89 and may be conventionally and adjustably fastened to the elongate guide members 86, 89.

Figure 4:
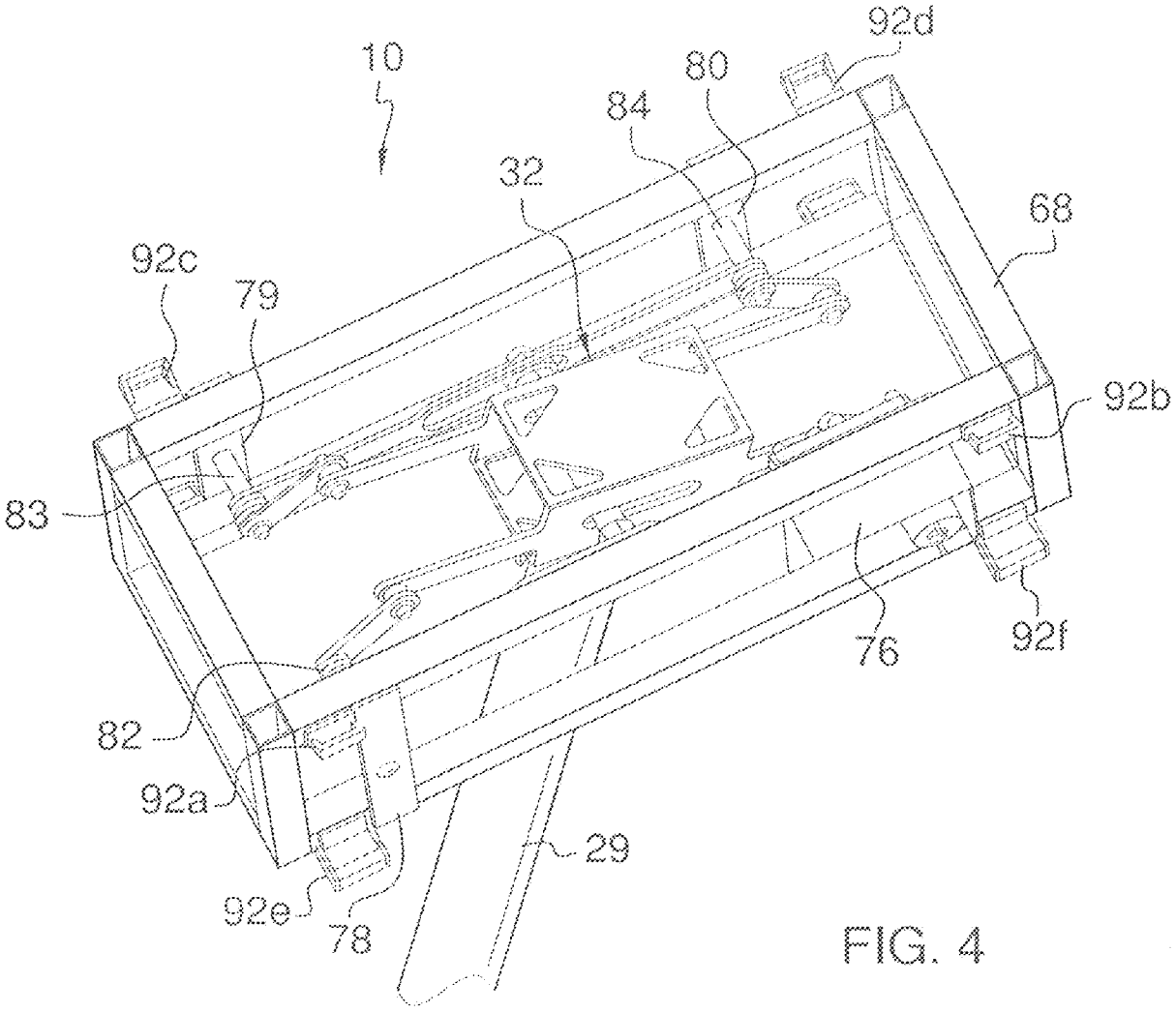
FIG. 4 is a partial top perspective view of the present invention.
Figure 5:
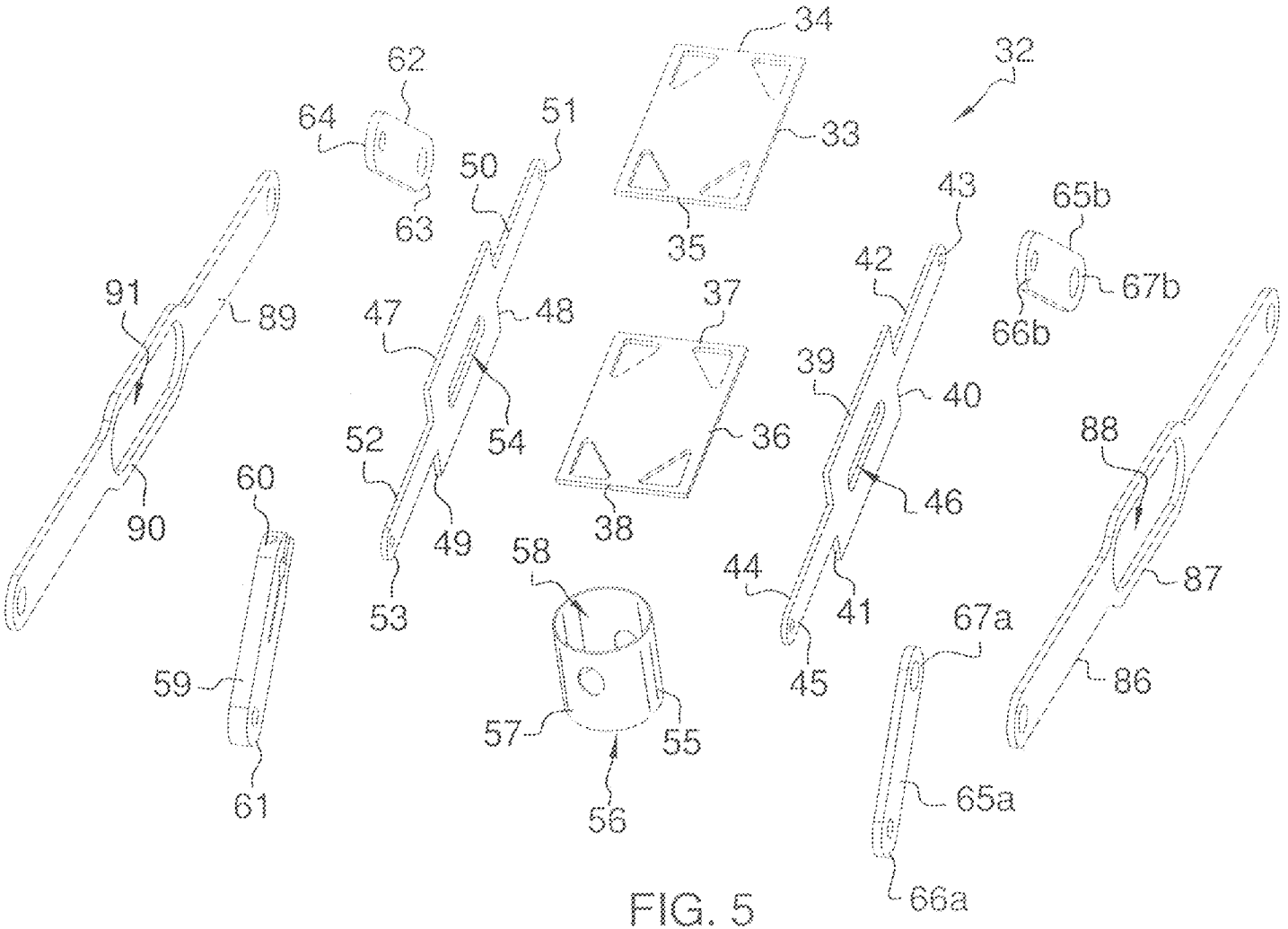
FIG. 5 is an exploded of the pivot member of the present invention.
Figure 6:
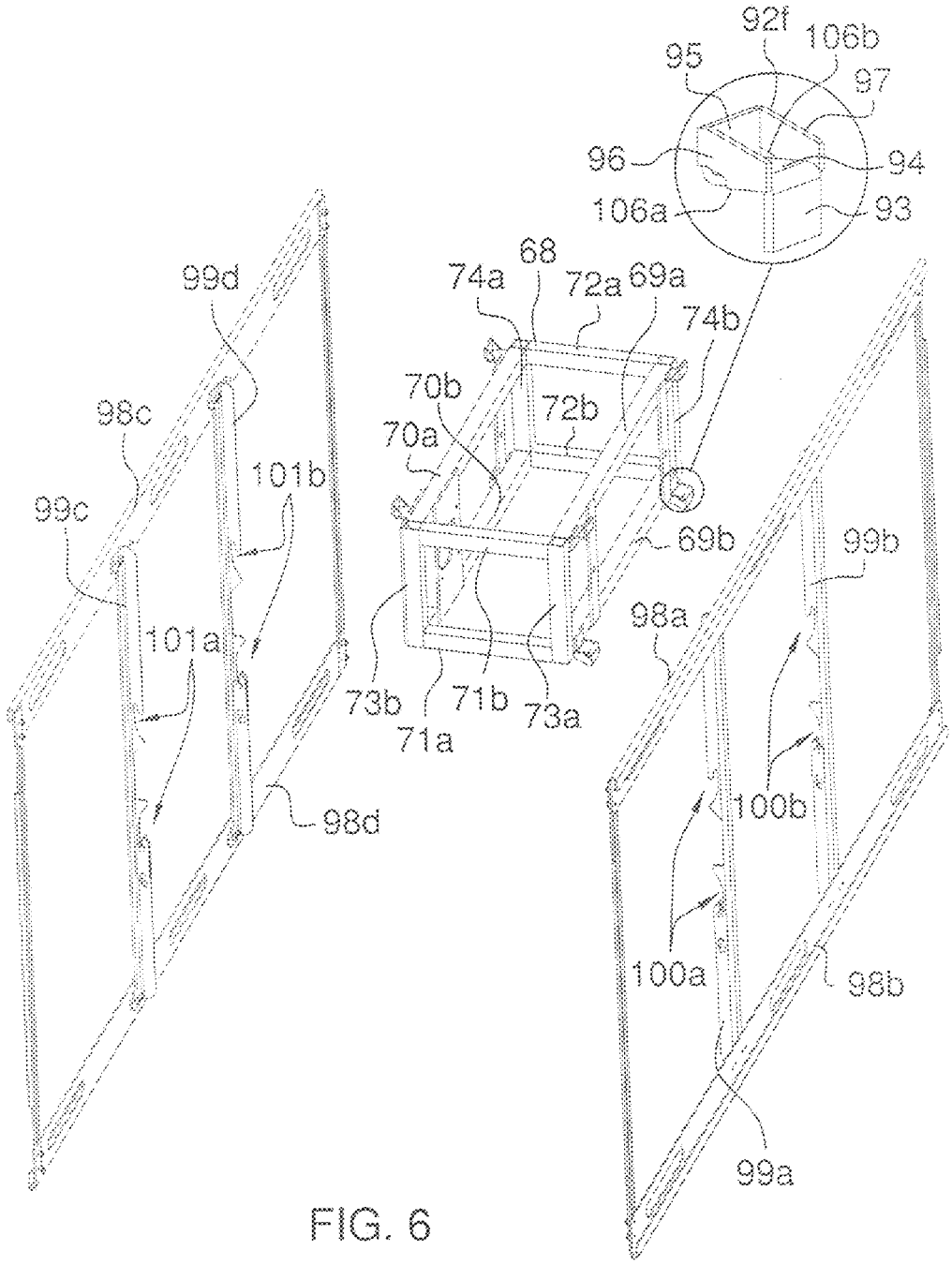
FIG. 6 is an exploded perspective view of the sign support assembly with an inset drawing of one of the sign support brackets of the present invention.

As shown in FIGS. 3 through 5, the sign support assembly 75 may also include sign support brackets 92*a-f* spaced apart and conventionally attached and welded to the elongate support members 69*a-b*, 70*a-b* for supporting the sign support members 103, 104. Each of the sign support brackets 92*a-f* may include a first planar portion 93 conventionally attached to a respective one of the elongate support members 69*a-b*, 70*a-b*, a second planar portion 94 angled relative to the first planar portion 93, a third planar portion 95 angled relative to the second planar portion 94 and disposed parallel to the first planar portion 93, and retaining walls 96, 97 conventionally attached and welded to side edges 106*a-b* of the second and third planar portions 94, 95 to retain the sign support members 103, 104 to the support brackets 92*a-f*. The sign support members 103, 104 may include a pair of elongate rails 98*a-d* spaced apart, a pair of end rails conventionally interconnecting and welded to the elongate rails 98*a-d*, and cross rails 99*a-d* spaced apart and conventionally interconnecting the elongate rails 98*a-d* and having slots 100*a-b*, 101*a-b* spaced along the cross rails 99*a-d* and obliquely disposed in the cross rails 99*a-b* for receiving the sign support brackets 92*a-f*.

In use, the mobile motionable sign apparatus 10 is used either for advertising purposes or for communicating a message and is commonly set up in a public place with the advertisement or message attached to and displayed upon the sign support members 103, 104. The battery 25 in the base member 12 energizes the gravity sensor 23, the sound-producing member 24 and also the motor 102 which actuates the rotation of the rotatable shaft 77 causing the linkage member 59, 62, 65 coupled to the rotatable shaft 77 to rotate with the rotatable shaft 77 and causing the motor support member 68 and the sign support members 103, 104 to rotated in a figure eight relative to the pivot member 32 and the base member 12 so that the advertisement or message is essentially moving back and forth relative to the pivot member 32 and the base member 12 thus catching the attention of the consumers.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the mobile motionable sign apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mobile motionable sign apparatus comprising:

a base assembly including a base member and a compartment disposed therein;

a motive support assembly removably coupled to the base member and including a pivot member;

a sign support assembly in communication with the pivot member and including a motor support member coupled and movable relative to the pivot member and further including a motor mounted to the motor support member and also including sign support members connectable to the motor support member; and a battery carried in the compartment and in communication with the motor for the energizing thereof and also includes a gravity sensor disposed in the compartment and in communication with the battery and further includes a sound-producing member in communication with the gravity sensor and the battery to emit an alarm upon the lifting of the base member a selected distance off a ground.

2. A mobile motionable sign apparatus comprising:

a base assembly including a base member;

a motive support assembly removably coupled to the base member and including a pivot member, wherein the motive support assembly also includes a first coupler attached to a top of the base member, and further includes an extendable pole removably extending upwardly from the base member and having a top end portion and a bottom end portion retainable in the first coupler, wherein the pivot member is removably retained about the top end portion of the extendable pole, and includes an upper plate, a bottom plate, opposed side plates spaced apart from one another and interconnecting the upper and bottom plates, and a second coupler depending from the bottom plate and removably retained about the top end portion of the extendable pole, wherein each of the side plates has a longitudinal slot disposed therethrough; and a sign support assembly in communication with the pivot member and including a motor support member coupled and movable relative to the pivot member and further including a motor mounted to the motor support member and also including sign support members connectable to the motor support member.

3. The mobile motionable sign apparatus as described in claim 2, wherein the pivot member further includes an elongate connector extending through and movable within the longitudinal slots of the side plates.

4. The mobile motionable sign apparatus as described in claim 3, wherein the sign support assembly further includes elongate guide members one of which interconnects the motor shaft to one of the posts and another of which interconnects other said posts.

5. The mobile motionable sign apparatus as described in claim 4, wherein each of the elongate guide members has an intermediate portion with a longitudinal slot disposed therethrough, wherein the elongate connector extends through the longitudinal slots of and is adjustably fastened to the elongate guide members and interconnects the pivot member to the elongate guide members.

6. A mobile motionable sign apparatus comprising:

a base assembly including a base member;

a motive support assembly removably coupled to the base member and including a pivot member, wherein the motive support assembly also includes a first coupler attached to a top of the base member, and further includes an extendable pole removably extending upwardly from the base member and having a top end portion and a bottom end portion retainable in the first coupler, wherein the pivot member is removably retained about the top end portion of the extendable pole, and includes an upper plate, a bottom plate, opposed side plates spaced apart from one another and interconnecting the upper and bottom plates, and a second coupler depending from the bottom plate and removably retained about the top end portion of the extendable pole, wherein the side plates have opposed ends, wherein the pivot member further includes elongate extension members integrally attached to the side plates and longitudinally aligned and extending outwardly from the side plates with each of the elongate extension members having a distal end and with each of the elongate extension members attached to a respective said opposed end of a respective said side plate; and a sign support assembly in communication with the pivot member and including a motor support member coupled and movable relative to the pivot member and further including a motor mounted to the motor support member and also including sign support members connectable to the motor support member.

7. The mobile motionable sign apparatus as described in claim 6, wherein the top and bottom plates have opposed ends with the elongate extension members extending outwardly beyond the ends of the top and bottom plates.

8. The mobile motionable sign apparatus as described in claim 6, wherein the motive support assembly also includes linkage members each having first and second ends with each of the first ends journaled to a respective said distal end of a respective said elongate extension member with the linkage members being rotatable relative to the elongate extension members and to the pivot member.

9. The mobile motionable sign apparatus as described in claim 8, wherein the motor support member includes elongate support members spaced apart and also includes lateral support members attached to the elongate support members, and further includes cross support members attached to the elongate support members and to the lateral support members to form a rectangular frame.

10. The mobile motionable sign apparatus as described in claim 9, wherein the sign support assembly also includes a motor bracket attached to one or more of the elongate support members with the motor attached to the motor bracket and having a rotatable shaft, and further includes post support members each attached to one or more of the elongate support members.

11. The mobile motionable sign apparatus as described in claim 9, wherein the sign support assembly also includes posts each fastened to a respective said post support member and extending inwardly of the motor support member and disposed perpendicular to a longitudinal axis of each of the elongate support members, wherein each of the posts is journaled to a respective said second end of a respective said linkage member.

12. The mobile motionable sign apparatus as described in claim 9, wherein the sign support assembly also includes sign support brackets spaced apart and attached to the elongate support members for supporting the sign support members.

13. The mobile motionable sign apparatus as described in claim 12, wherein each of the sign support brackets includes a first planar portion attached to a respective one of the elongate support members, a second planar portion angled relative to the first planar portion, a third planar portion angled relative to the second planar portion and disposed parallel to the first planar portion, and retaining walls attached to side edges of the second and third planar portions to retain the sign support members to the support brackets.

14. The mobile motionable sign apparatus as described in claim 13, wherein each of the sign support members includes a pair of elongate rails spaced apart and also includes cross rails spaced apart and interconnecting the elongate rails and having slots spaced along the cross rails and obliquely disposed in the cross rails for receiving the sign support brackets to support the sign support members upon the motor support member.

15. The mobile motionable sign apparatus as described in claim 8, wherein the rotatable shaft is coupled to the second end of one of the linkage members for rotation therewith, wherein the motor moves relative to the pivot member and to the base member when energized.

16. A mobile motionable sign apparatus comprising:

a base assembly including a base member;

a motive support assembly removably coupled to the base member and including a pivot member, wherein the motive support assembly also includes a first coupler attached to a top of the base member, and further includes an extendable pole removably extending upwardly from the base member and having a top end portion and a bottom end portion retainable in the first coupler, wherein the pivot member is removably retained about the top end portion of the extendable pole, and includes an upper plate, a bottom plate, opposed side plates spaced apart from one another and interconnecting the upper and bottom plates, and a second coupler depending from the bottom plate and removably retained about the top end portion of the extendable pole, wherein the second coupler is a tube depending from the bottom plate and having a longitudinal axis disposed perpendicular to the bottom plate and having an open distal end and a bore disposed therein and having a side wall, wherein the top end portion of the extendable pole is removably received in the bore of the tube with the pivot member fastenable to the extendable pole; and a sign support assembly in communication with the pivot member and including a motor support member coupled and movable relative to the pivot member and further including a motor mounted to the motor support member and also including sign support members connectable to the motor support member.

* * * * *